US005434901A

United States Patent [19]

Nagai et al.

[11] Patent Number: 5,434,901

[45] Date of Patent: Jul. 18, 1995

[54] SOFT X-RAY MICROSCOPE

[75] Inventors: Komei Nagai; Yoshiaki Horikawa, both of Hachioji; Yoshinori Iketaki, Oume; Shoichiro Mochimaru, Hachioji, all of Japan

[73] Assignee: Olympus Optical Co., Ltd., Tokyo, Japan

[21] Appl. No.: 162,470

[22] Filed: Dec. 7, 1993

[30] Foreign Application Priority Data

Dec. 7, 1992 [JP] Japan ..... 4-326754

[51] Int. Cl.[6] ..... G21K 7/00

[52] U.S. Cl. ..... 378/43; 378/206

[58] Field of Search ..... 378/43, 206

[56] References Cited

U.S. PATENT DOCUMENTS 5,119,411 6/1992 Nakamura ..... 378/43

FOREIGN PATENT DOCUMENTS 64-3600A 1/1989 Japan .

3282300A 12/1991 Japan .

*Primary Examiner*—Craig E. Church

*Attorney, Agent, or Firm*—Stevens, Davis, Miller & Mosher

[57] ABSTRACT

In a soft X-ray microscope including a soft X-ray source for emitting soft X-rays, a condenser lens for focusing the soft X-rays onto a specimen under inspection, an objective lens for focusing soft X-rays emanating from the specimen, a soft X-ray detector for receiving the soft X-rays focused by the objective lens, and a visually observing optical system for forming a visible image of the specimen by converting an optical property of the specimen other than contrast and color into a contrast in brightness or color. The visually observing optical system may be formed as phase contrast microscope, dark field microscope, polarizing microscope, differential interference microscope, or fluorescent microscope. Then, alignment and focus adjustment can be performed by observing the visible image of the specimen without irradiating the specimen with the soft X-rays even if the specimen has substantially no contrast and color.

6 Claims, 15 Drawing Sheets

SOFT X-RAY MICROSCOPE

BACKGROUND OF THE INVENTION

1. Field of the Invention

The present invention relates to a soft X-ray microscope comprising a soft X-ray source for emitting soft X-rays, a condenser lens for projecting the soft X-rays emitted from the soft X-ray source onto a specimen, an objective lens for focusing soft X-rays emanating from the specimen onto a predetermined position, and a soft X-ray detector arranged at said predetermined position for detecting the soft X-rays focused by said objective lens.

2. Related Art Statement

It has been well known that many elements have their specific absorption edges situating within a soft-X ray region generally of a wavelength longer than several angstroms. Therefore, by suitably selecting a wavelength of soft-X rays, it is possible to effect an observation with high resolution and high contrast without performing a preparatory operation for specimens. Generally, a wavelength region of the soft X-ray extends from 2 Å which is the longest wavelength of the hard X-rays to 1000 Å which is the shortest wavelength of the vacuum ultraviolets, so that the wavelength region of the soft X-rays partially overlaps with a wavelength region from 300 to 1000 Å of the extreme ultraviolets.

For instance, within a so-called water window region between the Kα absorption edge of carbon (44 Å) and the Kα absorption edge of oxygen (23.7 Å), the absorption of water and protein differ from each other, and thus biological specimens having substantially no contrast and color under the visible light can be observed without performing any particular preparatory treatment such as dyeing. That is to say, biological specimens can be observed under living condition. Moreover, the Lα absorption edge of silicon which has been widely used as a semiconductor material is 126- and that of aluminum which has been also widely used as an electrode wiring material in a semiconductor device is 169.8 Å, so that if the observation is carried out by using soft X-rays having wavelengths which are slightly shorter than said absorption edges respectively, distributions of these materials in the semiconductor device can be observed with a high resolution.

Due to the above mentioned facts as well as the development in ultra fine machining technique, there have been developed various soft X-ray microscopes using soft X-rays.

In the soft X-ray microscope, in order to remove or suppress undesired absorption of soft X-rays due to the air, various optical systems constituting the soft X-ray microscope are usually arranged within a vacuums chamber.

The soft X-ray microscope includes various optical systems such as condenser lens and objective lens. There have been proposed several optical systems such as the Schwaltzschild optical system using reflection surfaces having a multiple coating for revealing a high reflection for soft X-rays having a given wavelength, the Wolter optical system utilizing the total reflection and the zone plate optical system utilizing the diffraction.

Upon inspecting a specimen with the aid of the soft X-ray microscopes, the specimen has to be aligned with respect the optical axis by moving the specimen in a direction perpendicular to the optical axis such that a desired portion of the specimen can be inspected and further the specimen has to be moved in a direction of the optical axis with respect to the objective lens to effect the focus adjustment. The alignment of the specimen and focus adjustment are carried out while the specimen is observed under the soft X-rays. That is to say, the alignment and focus adjustment are performed also in the vacuum, so that these operations could not be performed efficiently.

Furthermore, in case of observing biological specimens, it is desired to reduce a dose rate of soft X-rays as far as possible. That is to say, it is desired to prevent the specimen form being subjected to an unnecessary irradiation with the soft X-rays.

Usually a soft X-ray source is formed by a synchrotron radiation (SR) source and laser plasma source. The SR X-ray source is very large in size and quite expensive in cost, so that a plurality of users commonly utilize the SR source, and therefore it is not always possible to utilize the SR source for the alignment and focus adjustment at will. At any rate, it is desired to effect the alignment and focus adjustment without using the SR source. Further, the laser plasma source can generates soft X-rays only in a pulsatory manner having a repetition frequency of, for instance 10 Hertzs, so that during the alignment and focus adjustment, the image of the specimen can be seen in a stroboscopic manner and thus the alignment and adjustment could not be performed easily.

Therefore, it has been required an X-ray microscope comprising the visible light observing optical system by means of which the alignment and focus adjustment can be performed within the vacuum condition without using the soft X-ray source.

In order to avoid the above mentioned inconvenience, there have been proposed soft-X ray microscopes in which the alignment and focus adjustment can be performed in the atmosphere by incorporating a visible light observing optical system. For instance, in Japanese Patent Laid-open Publications Kokai Sho 64-3600 and Kokai Hei 3-282300, there are proposed X-ray microscopes having the visible light observing optical systems installed therein.

FIG. 1 is a schematic cross sectional view showing a soft X-ray microscope disclosed in the above mentioned Kokai Hei 3-282300. The soft X-ray microscope comprises a soft X-ray source 1 for emitting soft X-rays, a condenser lens 2 formed by the Schwaltzschild optical system, and a vacuum chamber 3 in which the X-ray source 1 and condenser lens 2 are installed. The soft X-rays emitted from the X-ray source 1 are projected onto a specimen 4 under inspection by means of the condenser lens 2. A reference numeral 5 denotes an objective lens formed by the Schwaltzschild optical system having the same construction as that of the condenser lens 2. A reference numeral 6 denotes a soft X-ray detector and a reference numeral 7 represents a soft X-ray filter for cutting off radiation components having longer wavelengths than that of the soft X-rays. These elements 5, 6 and 7 are also installed within the vacuum chamber 3 together with the specimen 4. Soft X-rays emanating from the specimen 4 are focused onto the detector 6 by means of the objective lens 5. In this manner, the objective lens 5 constitutes an enlargement optical system. The soft X-ray detector 6 is connected to a signal processing circuit and an image signal produced by this circuit is supplied to a monitor to display a visible image of the specimen on the monitor.

In addition to the above explained soft X-ray microscope system, there is further provided a visually observing optical system for inspecting the image of the specimen under the visible light. That is to say, a visible light source 11 is arranged outside the vacuum chamber 3 and a transparent window 12 is provided in a wall of the vacuum chamber. Within the vacuum chamber 3, there are arranged first and second prisms 13 and 14. The first prism 13 is arranged movably to be selectively inserted into an optical path between the X-ray source 1 and the condenser lens 2, and the second prism 14 is also arranged movably to be selectively inserted into an optical path between the objective lens 5 and the filter 7. The movement of these prisms are schematically depicted by double headed arrows.

When the first and second prisms 13 and 14 are placed into the optical paths shown in FIG. 1, visible light emitted by the visible light source 11 is made incident upon the first prism 13 and is then reflected by the prism along the optical path along which the soft X-rays are made incident upon the condenser lens 2. The visible light emanating from the specimen 4 is focused on an image plane with is conjunction with the X-ray detector 6 by means of the second prism 14 to form a visible image of the specimen 4. Then, this visible image is observed by means of an eyepiece 15 provided in the wall of the vacuum chamber 3.

The condenser lens 2 and objective lens 5 are formed by the Schwaltzschild optical system includes multiple coatings which have a large reflectance not only for the soft X-rays but also for the visible light, and therefore the condenser lens 2 and objective lens 5 can be used as the condenser lens and objective lens, respectively of the visually observing optical system.

When the first and second prisms 13 and 14 are inserted into the optical path of the soft X-ray microscope optical system and the visible light source 11 is lit on, the visible image of the specimen 4 can be observed. In this case, in the known soft X-ray microscope, the visible light observing optical system is constructed as the bright field microscope which can inspect the contrast and color the specimen. That is to say, in the known soft X-ray microscope, the contrast and color of the specimen are of converted into the visible image.

In general, biological specimens have very low contrast, so that it is difficult to observe visible images of the biological specimens by means of the above mentioned known visually observing optical system. Therefore, the specimens are usually dyed with suitable dyeing agents in a preparatory step. As explained above, the soft X-ray microscope has an advantage that the specimen can be observed without performing the preparatory step. Therefore, in the known soft X-ray microscope, when a specimen has a low contract or has substantially no color, the alignment of the specimen and focus adjustment have to be carried out by observing the soft X-ray image of the specimen. This results in an undesired increase in the dose rate of soft X-rays.

Moreover, for some specimens it is required to observe them with a higher resolution than that can be attained by the visually observing optical system. Also in this case, the specimen has to be observed under the soft X-rays.

As explained above, in the known soft X-ray microscope having the visually observing optical system, the specific advantages of the soft X-ray microscope could not be fully attained.

SUMMARY OF THE INVENTION

The present invention has for its object to provide a novel and useful soft X-ray microscope, in which the alignment and focus adjustment can be performed under the visible light even if a specimen has a low contrast and has substantially no color and thus could not be observed by the bright field microscope as long as a specimen has an optical property other than contrast and color such as phase construction, optical anisotropy, inclination or differential coefficient in phase, scattering, diffraction and fluorescent property.

It is another object of the invention to provide a novel and useful soft X-ray microscope, in which the alignment and focus adjustment can be carried out under the visible inspection even if a size of a specimen is smaller than a resolution of the visually observing optical system as long as a specimen has a large scattering, diffraction or a specimen produces fluorescent light by irradiation of exciting light having a wavelength longer than vacuum ultraviolet rays.

According to the invention, a soft X-ray microscope comprises:

- a soft X-ray source for generating soft X-rays;
- a condenser lens for projecting said soft X-rays emitted from said soft X-ray source onto a specimen;
- an objective lens for focusing soft X-rays emanating from the specimen onto a given position; and
- a soft X-ray detector provided at said given position for detecting the soft X-rays focused by said objective lens; and
- a visually observing optical system including a visually observing radiation source for emitting visually observing radiation, and an converting means for projecting the visually observing radiation emitted by said visually observing radiation source onto the specimen substantially along an optical path along which said soft X-rays are projected onto the specimen, and for converting an optical property of the specimen other than contrast or color of the specimen into a visible image.

In a preferable embodiment of the soft X-ray microscope according to the invention, the visually observing optical system is formed as the phase contrast microscope, said visually observing radiation source is formed by a visible light source for emitting visible light, and said converting means comprises a means for converting a phase difference which is introduced in the visible light transmitted through the specimen into the visible image.

As will be apparent from the description with reference to embodiments, in a preferable embodiment of the soft X-ray microscope according to the invention, the phase difference converting means comprises a slit arranged in an incident optical path between the visible light source and the specimen and a phase plate arranged in an exit optical path between the specimen and the position at with the visible image of the specimen is formed. In the phase contrast microscope, the phase difference between visible light rays transmitted through various portions of a specimen having different refractive indices or thicknesses can be observed as the visible image having a contrast in brightness. Therefore, even if the specimen has a too low contrast to be observed by the bright field microscope, it is possible to produce a visible image of the specimen having a high contrast and thus the specimen can be visually observed. In this manner, according to the invention, the alignment and focus adjustment can be performed without using the soft X-rays.

In another preferable embodiment of the soft X-ray microscope according to the invention, the visually observing optical system is constructed as the dark field microscope, in which said visually observing radiation source is formed by a visible light source for emitting visible light, and said converting means comprises a means for projecting the visible light onto the specimen, an objective lens for focusing visible light scattered or diffracted by the specimen, and a means for preventing visible light rays which are directly transmitted through and/or reflected by the specimen from being used to form the visible image of the specimen. According to the invention, said means for preventing the visible light rays may be arranged in an optical path between the visible light source and the specimen or in an optical path between the specimen and the position at which the image of the specimen is formed or in both of said optical paths. In a preferable embodiment of the soft X-ray microscope in which the visually observing optical system is formed as the dark field microscope, a numerical aperture of a condenser lens of the visually observing optical system is sufficiently larger than that of the objective lens, and a light shielding plate is arranged such that the visible light directly transmitted through the specimen is not made incident upon the objective lens. Therefore, it is possible to observe an image of the specimen in a dark background by means of scattered light or diffracted light emanating from the specimen. In this manner, even if the specimen has a low contrast, the image of the specimen can be visually observed when the specimen produces a large amount of scattered light or diffracted light. Moreover, even if the specimen is smaller than a resolution of the bright field microscope, the specimen can be visually observed as a bright spot within a dark background. In this manner, the alignment and focus adjustment can be performed without using the soft X-rays. It should be noted that the dark field microscope may be constructed both as the transmission type and the reflection type, so that either type of the dark field microscope may be installed within the soft X-ray microscope.

In another preferable embodiment of the soft X-ray microscope according to the invention, the visually observing optical system is constructed as the polarizing microscope comprising a polarizer arranged in the incident light and an analyzer arranged in the exiting light. In this polarizing microscope, it is possible to observe the optical anisotropy of the specimen. In this polarizing microscope, specimens such as minerals, fabrics, crystals and so on having the optical anisotropy can be visually observed even if they have low contrast. The polarizing microscope may be constructed not only as the reflection type but also as the transmission type.

In another preferable embodiment of the soft X-ray microscope according to the invention, the visually observing optical system is formed as the differential interference microscope, in which an interference element such as Wallaston prism is arranged in each of the incident light and exiting light. In this case, the phase inclination of the specimen can be observed as the image having a contrast in brightness or color. Therefore, even if a specimen has a low contrast, the image of the specimen can be visually observed if the specimen has a phase inclination. It should be noted that the differential interference microscope may be constructed as the reflection type or transmission type.

According to still another embodiment of the soft X-ray microscope according to the invention. the visually observing optical system includes a light source for generating exciting radiation having a wavelength longer than the vacuum ultraviolets, a condenser lens for projecting the exciting radiation onto the specimen along an optical path along which said soft X-rays are projected onto the specimen, and an observing means for observing fluorescent light emanating from the specimen.

In this soft X-ray microscope, the visually observing optical system is formed as the fluorescent microscope including the light source which emits the exciting light having the wavelength longer than the vacuum ultraviolets and may be formed by very high pressure mercury discharge lamp or xenon lamp and a means for shielding the exciting light from an optical path of the visually observing optical system. This exciting light shielding means may be formed by a dark field condenser lens for the transmission type and by a dichroic mirror for the reflection type. Therefore, even if a specimen is a biological substance having a low contrast, the specimen can be visually observed as long as the specimen generates fluorescent light upon the excitation with the light having the wavelength longer than the vacuum ultraviolets. Also in this soft X-ray microscope, the alignment and focus adjustment can be performed without using the soft X-rays. Further, use is made of the exciting light having the wavelength longer than the vacuum ultraviolets, so that the visual observation can be carried out under the atmospheric pressure. As stated above, the fluorescent microscope may be constructed either of the transmission type or the reflection type.

It should be noted that the above mentioned various kinds of visually observing microscopes according to the invention may be constructed by inserting slits or light shielding plates into the condenser lens and objective lens of the usual bright field microscope. Therefore, according to the invention, it is preferable to selectively use the slits and light shielding plates in accordance with specimens under observation. In this case, it is further preferable to exchange these elements from the outside of the vacuum chamber of the soft X-ray microscope.

Moreover, the visually observing microscope may be equally installed in various types of soft X-ray microscope using the Schwaltzschild optical system using reflection surfaces having a multiple coating for revealing a high reflection for soft-X rays having given wavelengths, the Wolter optical system using a total reflection and the zone plate optical system using diffraction.

Furthermore, the soft X-ray source may be formed by the SR source or laser plasma. In this case, it is possible to adopt the critical illumination in the visually observing optical system. However, it is preferable to utilize the Köhler's illumination which can perform a uniform illumination.

It is also possible to utilize a white light source such which emits both the soft X-rays and visible light rays. Also in this case, the advantage that the specimen is prevented from being unnecessarily irradiated with the soft X-rays during the alignment and focus adjustment.

DESCRIPTION OF THE PREFERRED EMBODIMENTS

Figure 1:
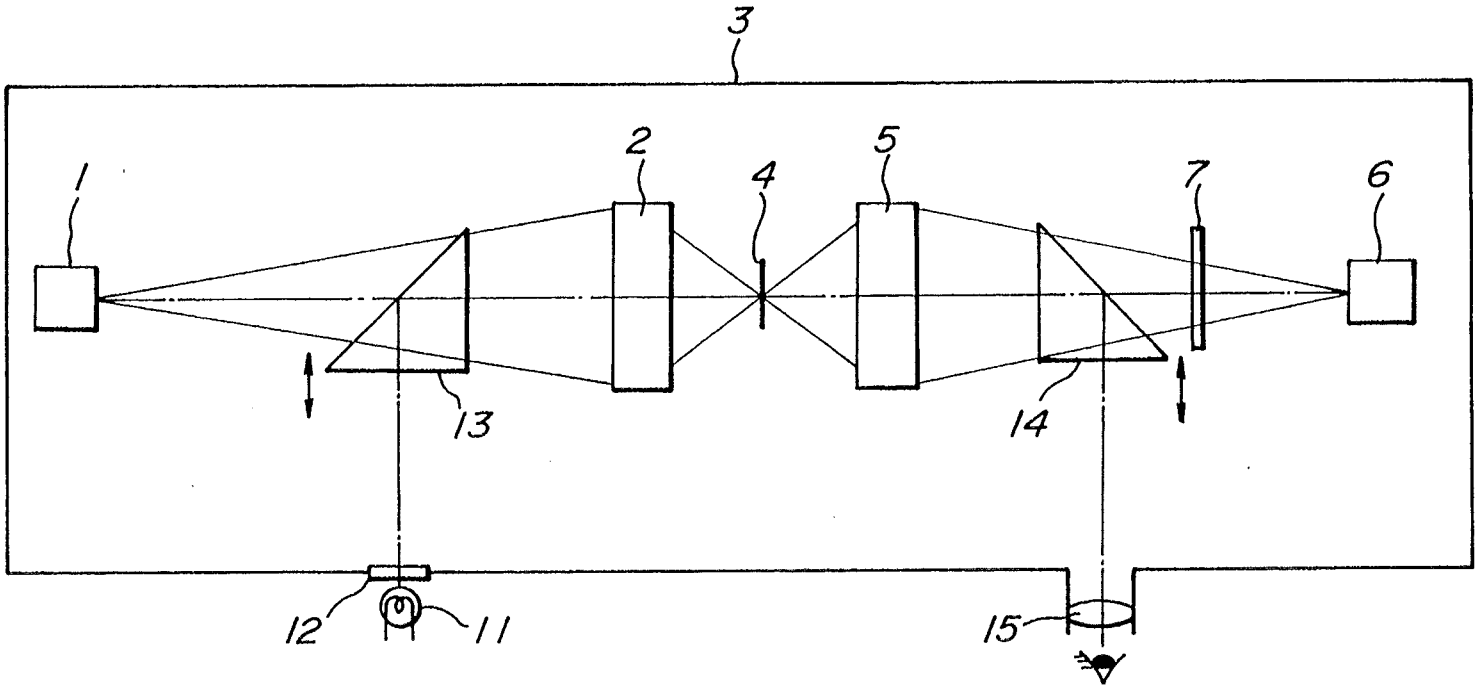
FIG. 1 PRIOR ART
FIG. 1 is a schematic view showing a known soft X-ray microscope having the visually observing optical system.
Figure 2:
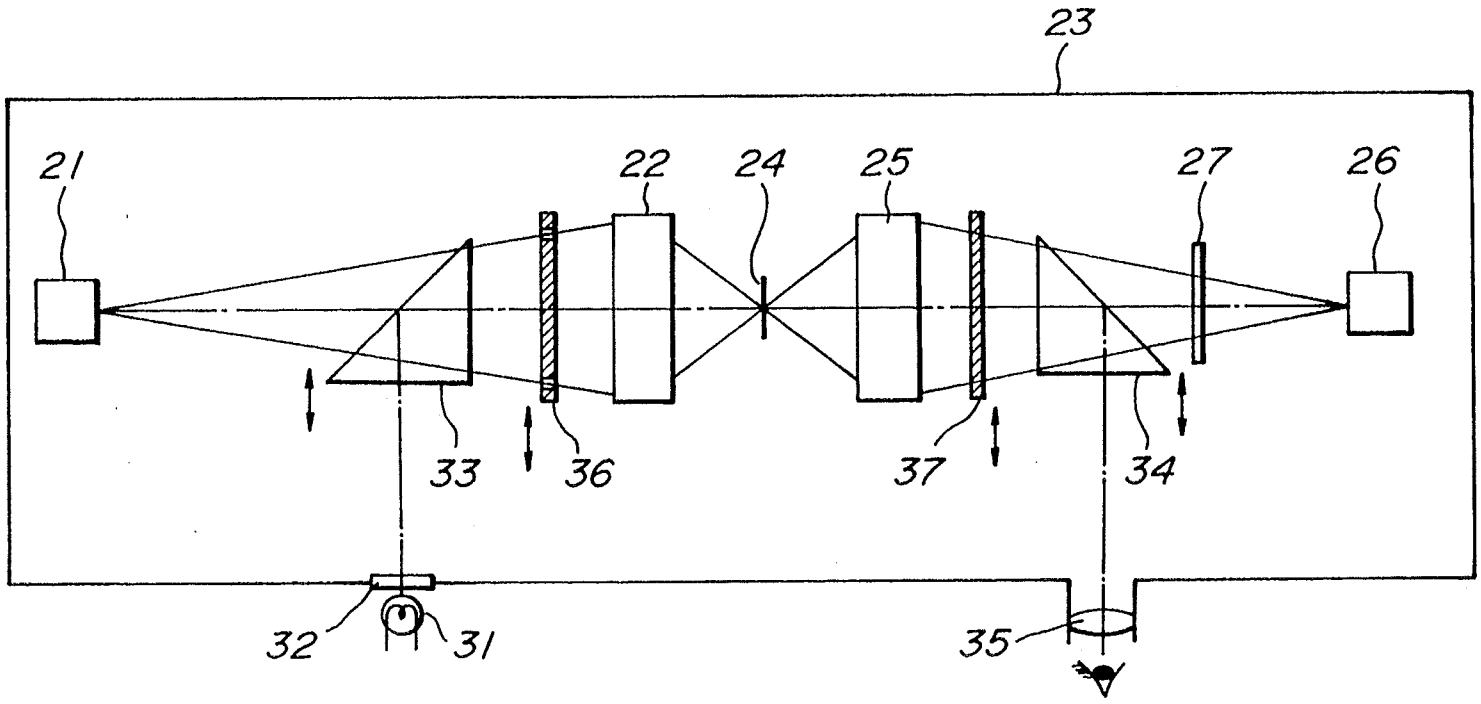
FIG. 2 is a schematic view depicting a first embodiment of the soft X-ray microscope according to the invention.

FIG. 2 is a schematic view showing a whole construction of a first embodiment of the soft X-ray microscope according to the invention. In the present embodiment, the visually observing optical system is formed as the phase contrast microscope. The principal construction of the soft X-ray microscope of the present invention is similar to that of the known soft X-ray microscope shown in FIG. 1 and comprises an X-ray illumination system including X-ray source 21 and condenser lens 22 formed by the Schwaltzschild optical system. The soft X-rays having a given wavelength are focused onto a specimen 24 by means of the condenser lens 22. Soft X-rays transmitted through or diffracted by the specimen 24 are focused by an objective lens 25 formed by the Schwaltzschild optical system onto a soft X-ray detector 26. In front of the detector 26 there is arranged a soft X-ray filter 27 for cutting off components having longer wavelengths than the given wavelength. The objective lens 25, detector 26 and soft x-ray filter 27 constitute an imaging optical system having an enlarging function. The above mentioned optical elements are arranged within a vacuum chamber 23 in order to avoid an absorption of the soft X-rays by the air.

The Schwaltzschild optical system forming the condenser lens 22 and objective lens 25 is constructed by multiple coatings having a high reflectance for the soft X-rays having the given wavelength. It should be noted that the multiple coatings have a high reflectance also for visible light rays, so that it can be advantageously utilized as a lens in the visually observing optical system constituting the phase-contrast microscope.

The soft X-ray microscope of the present embodiment further comprises a visible light source 31 for emitting visible light. The visible light emitted by the visible light source 31 is introduced into the vacuum chamber 23 via a transparent window 32 provided in a wall of the vacuum chamber, and then is made incident upon a first prism 33 which is removably arranged in an optical path between the soft X-ray source 21 and the condenser lens 22. The visible light is reflected by the first prism 33 and is made incident upon the condenser lens 22 along the substantially same optical path along which the soft X-rays are made incident upon the condenser lens 22. The light source 31, transparent window 32 and first prism 33 constitute an illuminating optical system of the visually observing optical system.

Figure 3A:
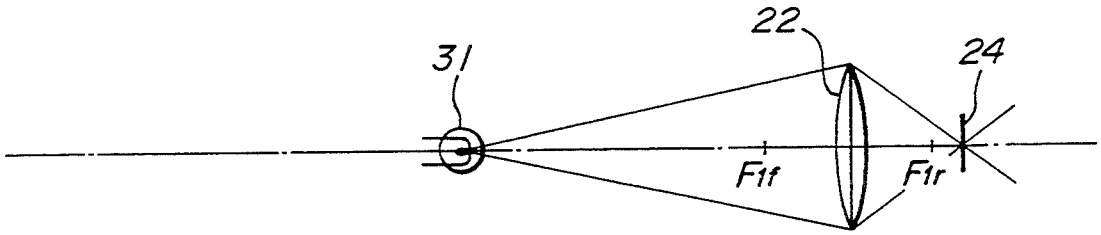
FIGS. 3A and 3B are schematic views illustrating the manner of illuminations which may be advantageously used in the soft X-ray microscope according to the invention.

In the present embodiment, the illuminating optical system is of the critical illumination system as shown in FIG. 3A. In FIG. 3A, Flf and Flr represent front and rear focus points, respectively of the condenser lens 22. As stated above, the condenser lens 22 serves also as the condenser lens of the illuminating optical system of the visually observing optical system.

Figure 3B:
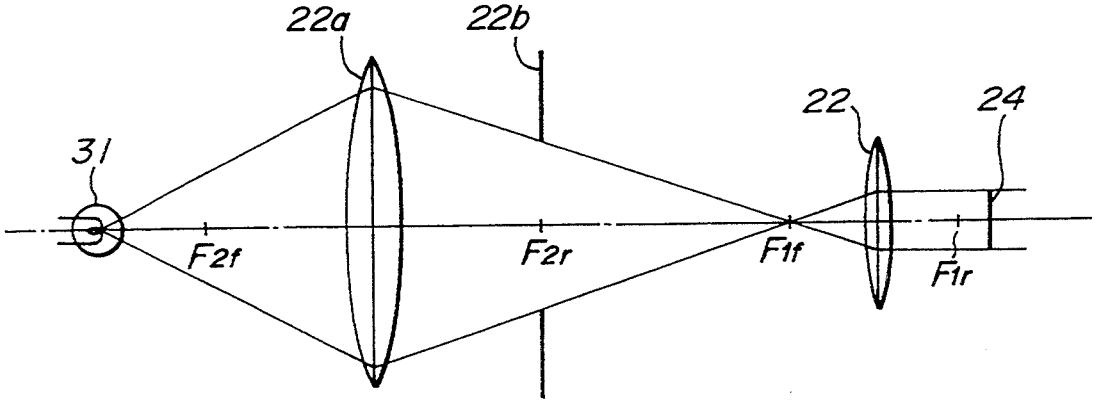

In the visually observing optical system, the critical illumination may be used, but it is preferable to utilize the Köhler's illumination which is free from the variation in illumination. As illustrated in FIG. 3B, the Köhler's illumination comprises an imaging or collimator lens **22*a* for forming an image of the visible light source 31** at the front focal point F1*f* of the condenser lens 22 and a stop **22*b*** which is positioned at a rear focal point F2*r* of the imaging lens **22*a* and whose image is formed by the condenser lens 22 at the plane of the specimen 24**. In FIG. 3B, F1*f* and F2*f* represent front focal points of the condenser lens 22 and imaging lens **22*a*, respectively. In this illumination system, the specimen 24** can be uniformly illuminated.

Figure 4:
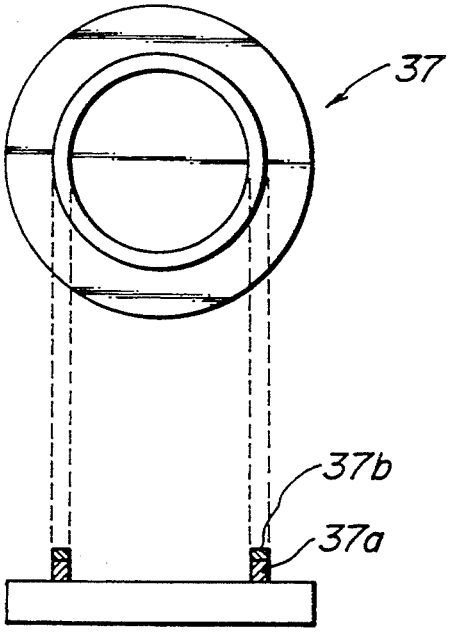
FIG. 4 shows the construction of the phase plate shown in FIG. 2.

As shown in FIG. 2, visible light emanating from the objective lens 25 is reflected by a second prism 34 which is removably arranged in an optical path between the objective lens 25 and the detector 26. Therefore, the image of the specimen 24 is formed on a plane which is conjugate with the soft X-ray detector 26, and this image is observed by means of an eyepiece 35 provided in the wall of the vacuum chamber 23. In this manner, the specimen 24 can be visually observed from the outside of the vacuum chamber 23. The second prism 34 and eyepiece 35 constitute the imaging optical system of the visually observing optical system. In the present embodiment, the visually observing optical system is constructed as the phase-contrast microscope, in which phase differences due to variations in refractive index or thickness of various portions of the specimen 24 can be visually observed as a contrast in brightness in the visible image. To this end, a ring slit plate 36 having a ring slit is removably arranged in the incident optical path of the visible light at a pupil of the condenser lens 22 and a phase plate 37 is removably arranged in the exit optical path of the visible light at a pupil of the objective lens 25. As depicted in FIG. 4, the phase plate 37 comprises a ring-shaped thin film 37*a* for delaying the phase of the visible light passing therethrough by $\frac{1}{4}\lambda$ and a absorption film 37*b* for absorbing or decaying zero order light along a ring-shaped image of the ring slit of the ring slit plate 36.

In the thus constructed phase-contrast microscope, even if the specimen 24 is substantially transparent and has a very low contrast or has substantially no color, the phase difference of the specimen is converted into the contrast, so that the specimen can be visually observed. In other words, the zero order diffraction image is identical with the ring-shaped geometric image, so that when the optical brightness and density of this portion of the phase plate 37 are changed, the amplitude and phase of the zero order diffraction light are changed and the thus changed zero order light is mixed with higher order diffraction lights, the contrast of the image is changed and the image of the specimen can be visually observed.

In the present embodiment, under the condition that the X-ray source 21 is deenergized, the observation of the specimen with the visible light by means of the eyepiece 35 can be performed by energizing the light source 31 and inserting the first and second prisms 33 and 34 into the optical path. In this case when the specimen 24 has a too low contrast to be visually observed, the ring slit plate 36 and phase plate 37 are inserted into the optical path, the visually observing optical system is changed from the bright field microscope into the phase-contrast microscope. Therefore, even if the specimen has a low contrast like as usual biological specimen, the image of the specimen 24 can be visually observed. It should be noted that the above explained visual observation may be carried out in regardless of the fact that the vacuum chamber 23 is evacuated or not. In this manner, when the visually observing optical system is constructed as the phase-contrast microscope, a biological specimen having small differences in refractive index can be visually observed as the contrast image, so that the alignment of the specimen and focus adjustment can be performed without irradiating the specimen with the soft X-rays. Therefore, the specimen can be effectively prevented from being irradiated with the soft X-rays during the alignment and focus adjustment, and thus the biological specimen can be inspected under the soft X-rays in a natural condition as far as possible without performing the preparatory treatment or dyeing.

Figure 5:
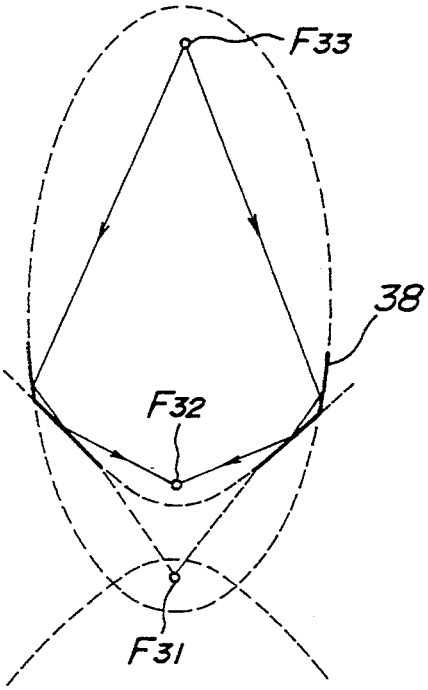
FIG. 5 is a schematic view illustrating another embodiment of the condenser lens.
Figure 6:
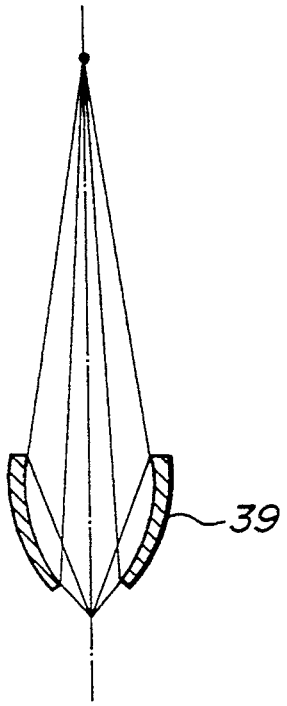
FIG. 6 is a schematic view showing still another embodiment of the condenser lens.

In the soft X-ray microscope, the imaging property of the condenser lens 22 can be made lower than the objective lens 25, so that the condenser lens 22 may be formed by the Wolter optical system 38 shown in FIG. 5. The Wolter optical system 38 is formed by a combination of a hyperboloid of rotation and an ellipsoid of rotation. In FIG. 5, F33 denotes a focus point of the ellipsoid of rotation, F32 a focal point of the hyperboloid of rotation and F31 a common focal point of the ellipsoid of rotation and hyperboloid of rotation. The X-ray source 21 is positioned at the focal point F33 and the specimen 24 is placed at the focal point F32. Alternatively the condenser lens 22 may be formed by an optical system 39 illustrated in FIG. 6, in which the optical system is formed by a mirror having a shape of an ellipsoid of rotation.

In the present embodiment, the ring slit plate 36 is used, but a slit having any other shape or a pin hole may be used. In this case, a thin film for delaying the phase by $\frac{1}{4}\lambda$ and a thin film for decaying the zero order diffraction light are provided on the phase plate 37 at position at which the image of the slit or pin hole is formed.

Figure 7:
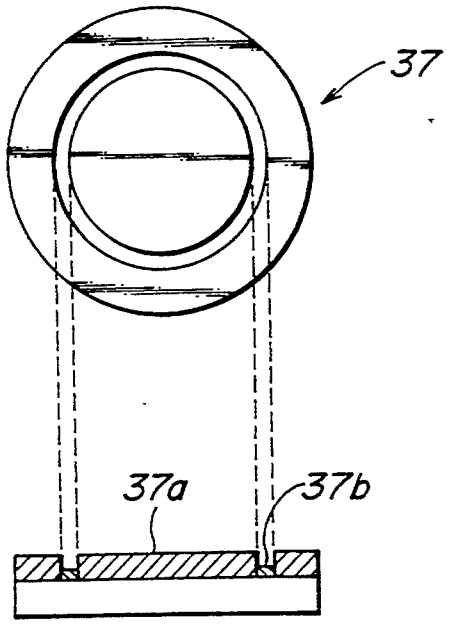
FIG. 7 is a another embodiment of the phase plate.

Further, the phase plate 37 may formed as shown in FIG. 7, in which the thin film 37*a* for delaying the phase by $\frac{1}{4}\lambda$ is applied on a portion other than the image of the ring slit and the thin film 37*b* for decaying the zero order diffraction light is provided at the position of the ring slit image. By using such a phase plate, the brightness of the specimen image are inverted.

Figure 8:
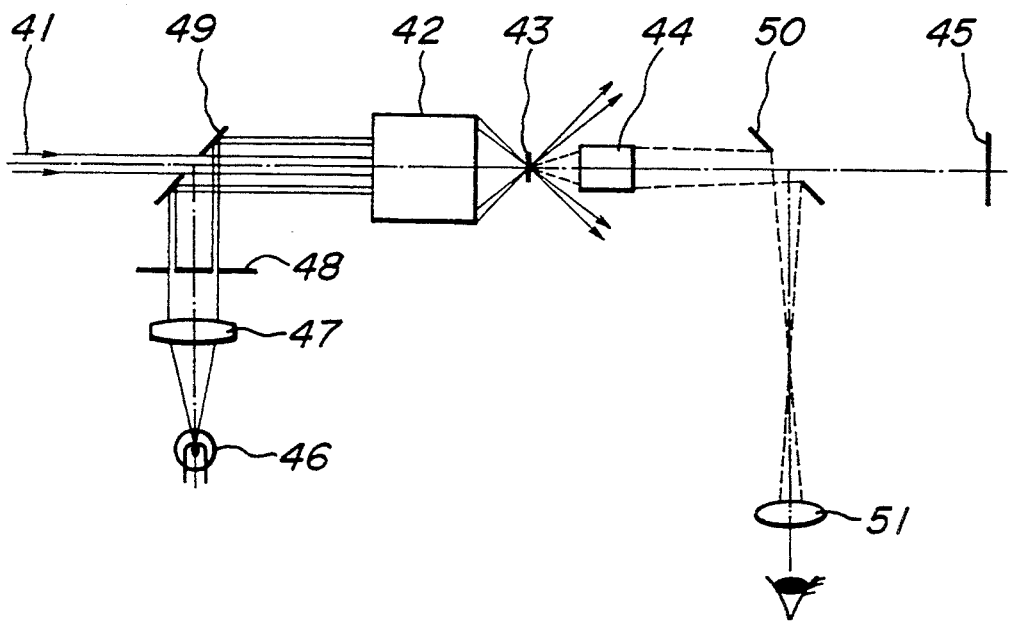
FIG. 8 is a schematic view depicting a second embodiment of the soft X-ray microscope according to the invention.

FIG. 8 is a schematic view showing a second embodiment of the soft X-ray microscope according to the invention. In the present embodiment, the condenser lens and objective lens are formed by the zone plate optical system. Soft X-rays 41 emitted by SR and monochromated by means of a glass hopper type spectrometer not shown are introduced into a condenser lens system 42 including a zone plate optical system of the soft X-ray microscope and an illumination condenser lens of the visually observing optical system. The soft X-rays are focused by the condenser lens system 42 onto a specimen 43.

Soft X-rays transmitted through or diffracted by the specimen 43 are focused by an objective lens system 44 including a zone plate optical system of the soft X-ray microscope and an objective lens of the visually observing optical system onto a soft X-ray detector 45. In this manner it is possible to obtain an enlarged X-ray image of the specimen 43 on the detector 45. The above mentioned elements are provided within a vacuum chamber not shown. If the glass hopper type spectrometer is not provided in the X-ray source, it is necessary to arrange a monochromatic zone plate in front of the condenser lens system or an X-ray filter in front of the detector 45.

Figure 9:
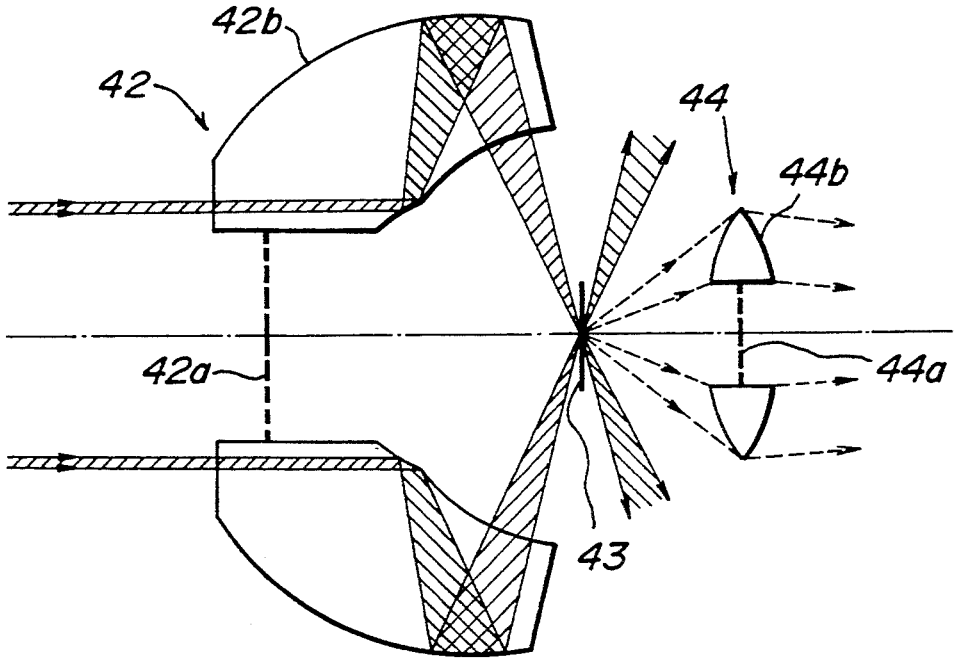
FIG. 9 is a schematic view representing the detailed construction of the confessor lens and objective lens shown in FIG. 8.

FIG. 9 is a schematic view showing a detailed construction of the condenser lens system 42 and objective lens system 44 of the present embodiment. The condenser lens system 42 comprises a confessor zone plate 42*a* for the soft X-ray microscope and a condenser lens 42*b* for the visually observing optical system, and the objective lens system 44 includes a objective zone plate 44*a* for the soft X-ray microscope and an objective lens 44*b* for the visually observing optical system.

In order to observe the specimen 43 under the visible light, there are arranged visible light source 46, collimator lens 47, ring slit 48, first mirror 49, second mirror 50, and eyepiece 51. Each of the first and second mirrors 49 and 50 has an aperture formed therein so that the soft X-rays are not interrupted by these mirrors. The illuminating optical system of the visually observing optical system is formed by the visible light source 46, collimator lens 48, ring slit 48, first mirror 49 and condenser lens 42*b*, and the visible light emitted by the visible light source 46 is made incident upon the specimen 43 by the condenser lens 42*b* along the substantially same optical path along which the soft X-rays are made incident upon the specimen. The imaging optical system of the visually observing optical system is formed by the objective lens 44*b*, second mirror 50 and eyepiece 51. In the present embodiment, the illuminating optical system is constructed as the dark field illumination. To this end, the numerical aperture of the condenser lens 42*b* is larger than that of the objective lens 44*b* and the visible light transmitted through the specimen 43 is not directly made incident upon the objective lens 44*b*. Furthermore, a part of the illumination light is shielded or cut off by means of the ring slit 48.

In the present embodiment, when the visible light source 46 is lit on, the specimen 43 is illuminated with the visible light by means of the condenser lens 42*b* and the zero order light transmitted through the specimen 43 is not made incident upon the objective lens 44*b*. Therefore, only visible light rays scattered or diffracted by the specimen 43 are made incident upon the objective lens 44*b*. In this manner, an image of the specimen with the scattered or diffracted light rays can be clearly seen in the dark background. Further, the first and second mirrors 49 and 50 have the apertures and the soft X-rays can freely pass through the apertures of these mirrors, it is not necessary to remove these mirrors from the optical path when the inspection under the soft X-rays is carried out. Also in this embodiment, the alignment and focus adjustment for the specimen 43 can be performed in regardless of the fact that the vacuum chamber is evacuated or not.

As explained above, when the visually observing optical system is constructed as the dark field microscope, the contrast can be obtained by the light rays scattered or diffracted by the specimen, and thus the alignment of the specimen and focus adjustment can be effected by visually observing the image of the specimen. During this alignment and adjustment, it is no more necessary to irradiate the specimen with the soft X-rays, and thus the specimen can be prevented from being unnecessarily exposed to a large amount of the soft X-rays. This is particularly advantageous for inspecting the biological specimen without performing the preparatory operation and dyeing. Further, when the alignment and focus adjustment are performed under the visible inspection, these operations are not affected by the working time of the SR X-ray source or the pulsatory illumination of the laser plasma X-ray source.

Figure 10:
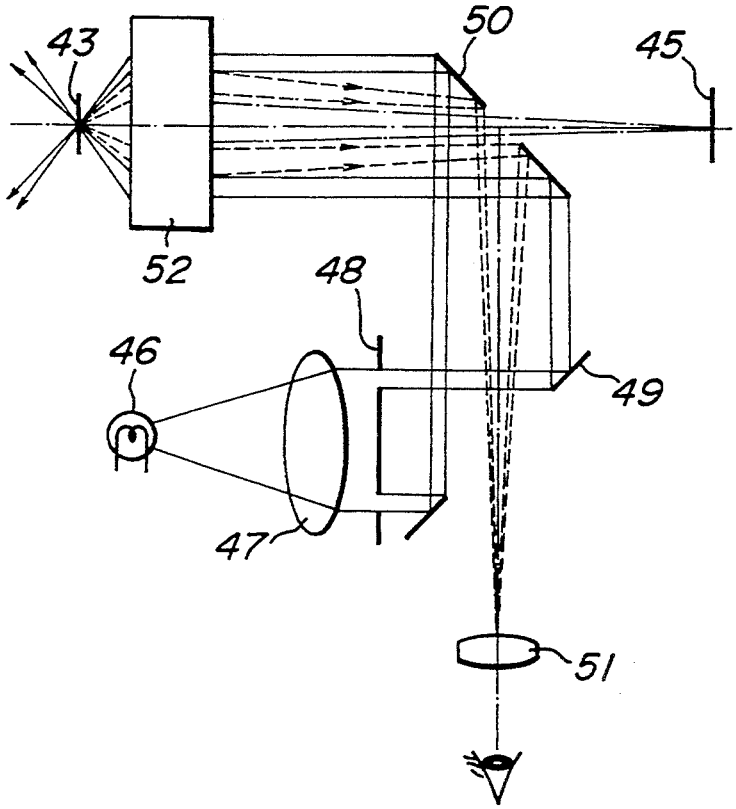
FIG. 10 is a schematic view illustrating a third embodiment of the soft X-ray microscope according to the invention.

FIG. 10 is a schematic view showing a third embodiment of the soft X-ray microscope according to the invention. Also in the present embodiment, the basic optical system of the soft X-ray microscope is same as that of the previous embodiment shown in FIGS. 8 and 9 and is formed by the zone plate optical system. However, in the present embodiment, the illumination of the visually observing optical system is constructed as of reflection type. In the present embodiment, portions similar to those shown in FIG. 8 are denoted by the same reference numerals used in FIG. 8. There are provided visible light source 46, collimator lens 47, ring slit 48, first and second mirrors 49 and 50, and eyepiece 51. In the present embodiment, the first mirror 49 is arranged out of the optical path of the soft X-ray microscope, but the second mirror 50 is arranged in the optical path. The visible light emitted from the light source 46 is made incident upon the first mirror 49 by means of the collimator lens 47 and ring slit 48, and then the visible light is reflected by the first mirror 49 toward the second mirror 50 and is reflected thereby toward a composite lens system 52.

Figure 11:
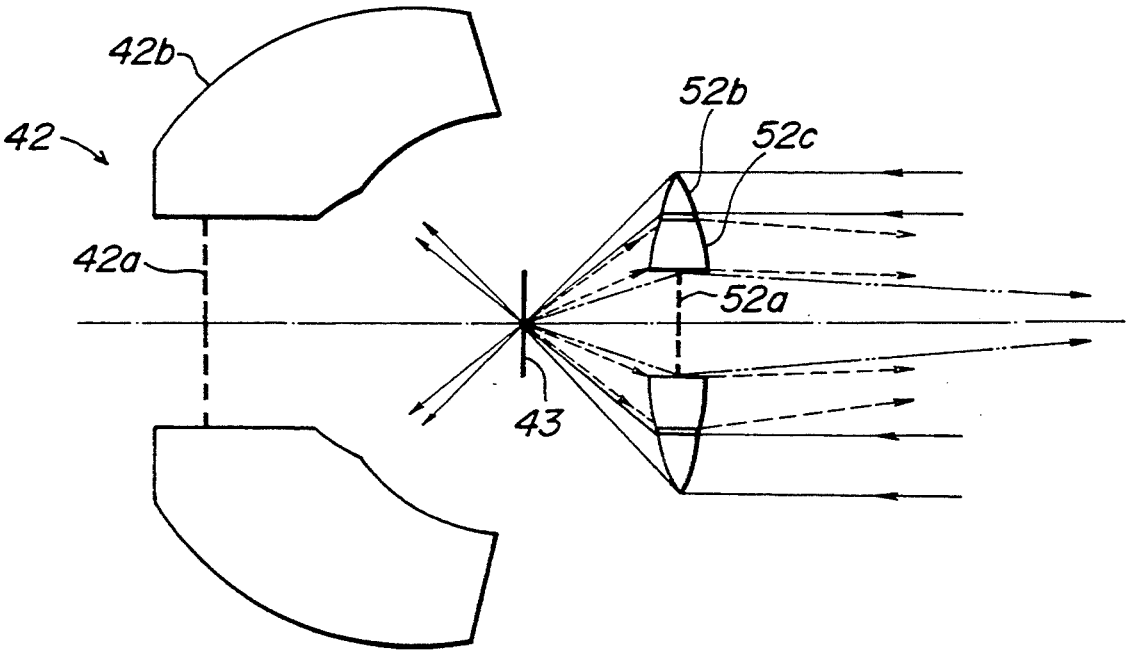
FIG. 11 is a schematic view depicting a detailed construction of the objective lens system.

FIG. 11 shows a detailed construction of the composite lens system 52. In the present embodiment, the composite lens system includes an objective zone plate 52*a* of the soft X-ray microscope, condenser lens 52*b* and objective lens 52*c* of the visually observing optical system. The visible light reflected by the second mirror 50 is made incident upon the condenser lens 52*b* in the composite lens system 52 and is focused onto the specimen 43. Visible light rays reflected by the specimen 43 are then made incident upon the objective lens 52*c*. In this case, the numerical aperture of the condenser lens 52*b* is sufficiently larger than that of the objective lens 52*c*, so that the zero order reflection light from the specimen 43 is not made incident upon the objective lens 52*c*. The visible light emanating from the objective lens 52*c* is then reflected by the second mirror 50 toward the eyepiece 51. It should be noted that the soft X-rays emanating from the objective zone plate 52*a* are made incident upon the detector 45 via the aperture formed in the second mirror 50, so that it is no more necessary to arrange the second mirror removably from the optical path during the inspection under the soft X-rays.

Also in the present embodiment, it is possible to observe the specimen 43 under the visible light without irradiating the specimen 43 with the soft X-rays, and thus the alignment and focus adjustment for the specimen can be performed irrespective of the fact that the vacuum chamber is evacuated or not. The zero order light reflected by the specimen 43 is not made incident upon the objective lens 52*c*, and therefore the image of the specimen can be obtained by the light rays scattered or diffracted by the specimen. That is to say, only portions of the specimen 43 which cause the scattering or diffraction can be clearly seen in the dark background.

In the present embodiment, the visual observation is performed by the reflection type illumination, and thus it is not necessary to use the condenser lens system 42 including the condenser lens 42*b* shown in FIG. 11. In a first modified embodiment of the present third embodiment, the condenser lens 42*b* is used to selectively change the visually observing optical system as the transmission type dark field visually observing optical system like as the second embodiment shown in FIG. 8.

Figure 12:
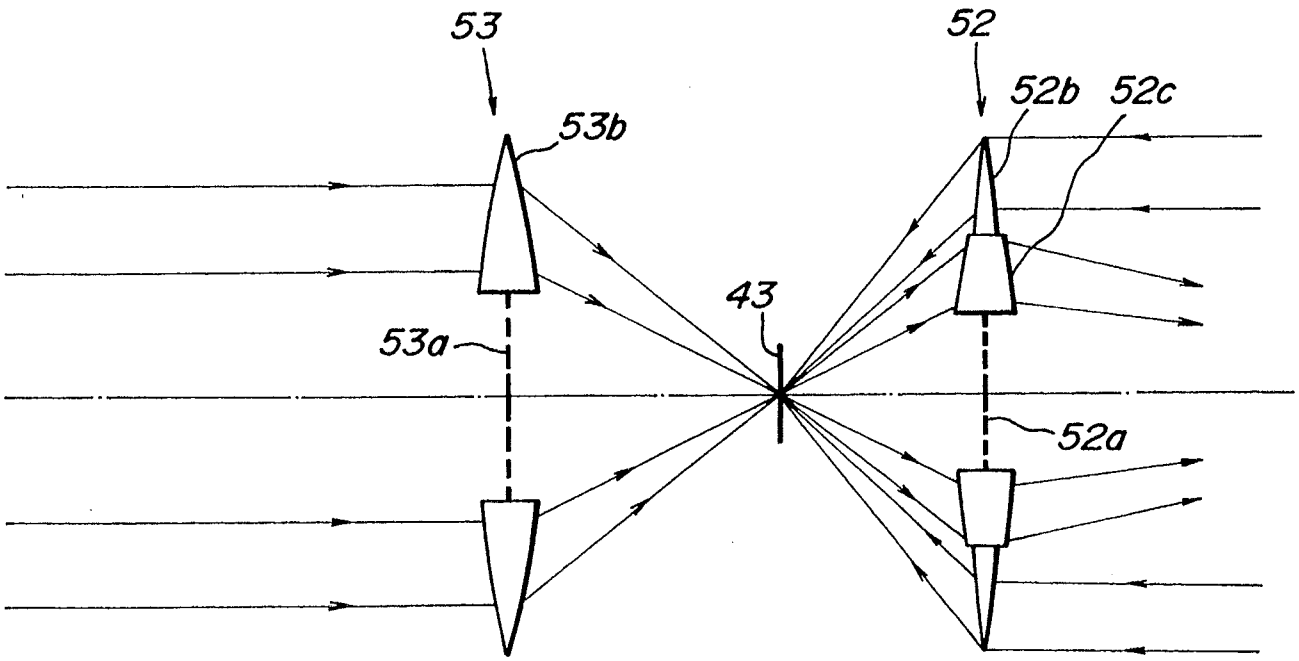
FIG. 12 is a schematic view showing another embodiment of the objective lens system.

FIG. 12 shows a second modified embodiment of the third embodiment of the soft X-ray microscope according to the invention. In this embodiment, a condenser lens system 53 comprising a condenser zone plate 53*a* for the soft X-ray microscope and a condenser lens 53*b* for the visually observing optical system. The condenser lens 53*b* is constructed such that the zero order visible light transmitted through the specimen 43 is made incident upon the objective lens 52*c* of the composite lens system 52. Then, it is possible to observe the image of the specimen under the visible light with the aid of the usual bright field transmission type microscope.

Figure 13:
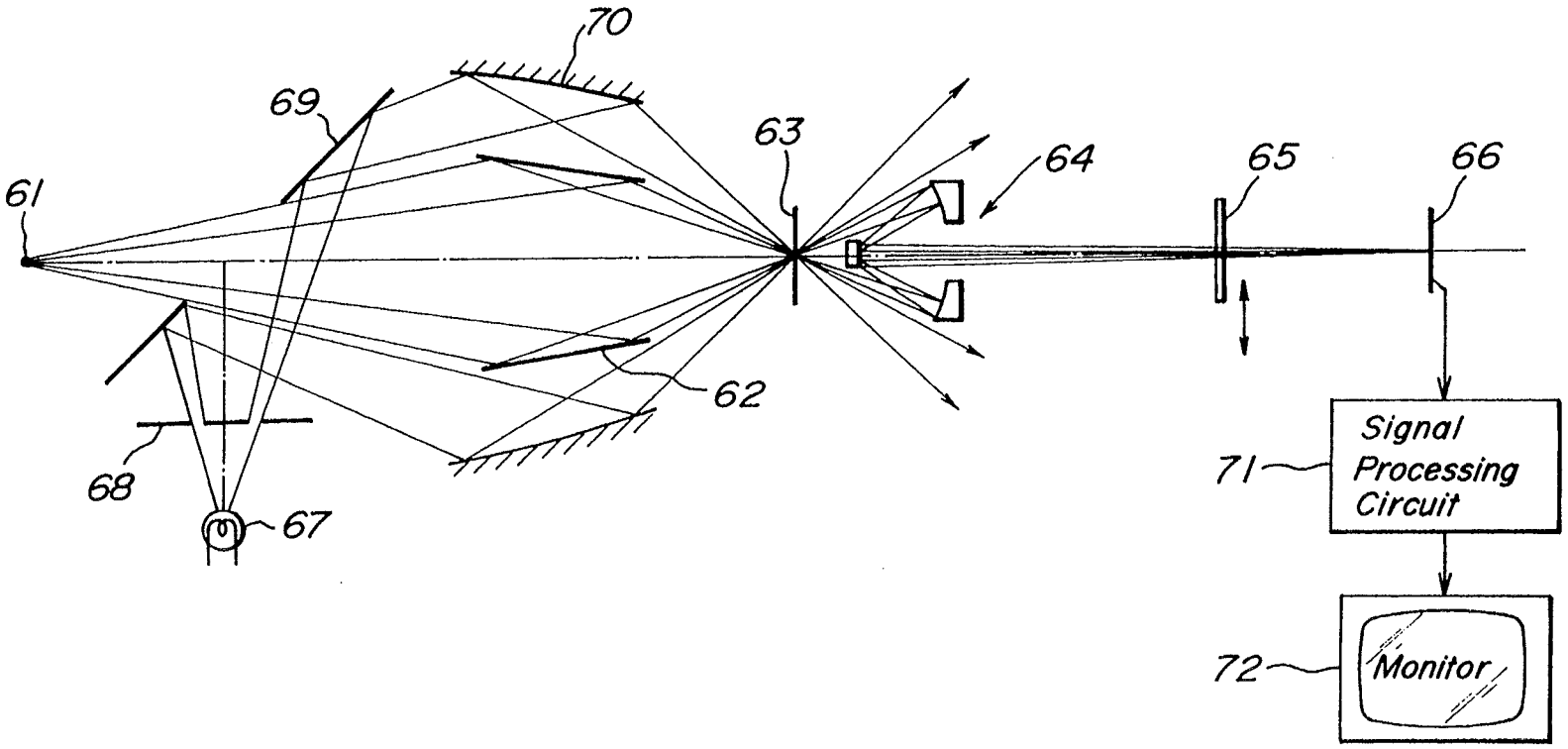
FIG. 13 is a schematic view illustrating a fourth embodiment of the soft X-ray microscope according to the invention.

FIG. 13 is a schematic view illustrating a fourth embodiment of the soft X-ray microscope according to the invention. In the present embodiment, the condenser lens and objective lens for the soft X-ray observation are formed by the Schwaltzschild optical system. Soft X-rays emitted by a soft X-ray source 61 is focused by a condenser lens 62 onto a specimen 63, and soft X-rays emanating from the specimen 63 are focused by an objective lens 64 onto a soft X-ray detector 66 via a soft X-ray filter 65. In the present embodiment, the condenser lens 62 is formed by a mirror having a shape of ellipsoid of rotation. This mirror is made of oxygen-free copper which has a high reflectance not only for the soft X-rays but also for the visible light rays. Therefore, the condenser mirror lens 62 has to be formed by a sufficiently thin copper plate such that the visible light is not shielded or cut off thereby.

Soft X-rays transmitted through or diffracted by the specimen 63 are focused by the objective lens 64 formed by the Schwaltzschild optical system onto the soft X-ray detector 66 via the soft X-ray filter 65. In the present embodiment, the soft X-ray detector 66 is formed by a semiconductor sensor which has a sensitivity not only for the soft X-rays but also for the visible light. For instance, the soft X-ray detector 66 may be formed by CCD (charge coupled device). The soft X-ray filter 65 serves as a filter for cutting off components having longer wavelengths as well as the visible light, so that the soft X-ray filter is arranged removably from the optical path as shown by a double headed arrow in FIG. 13. The above mentioned elements are installed within a vacuum chamber not shown in order to avoid the absorption of the soft X-rays by the air.

In the present embodiment, the visually observing optical system comprises visible light source 67, ring slit 68, mirror 69, and objective lens 70. The mirror 69 has an aperture formed therein such that the soft X-rays emitted from the soft X-ray source 61 can pass through the mirror 69. Therefore, it is not necessary to arrange the mirror removably from the optical path. The condenser lens 70 is formed by a mirror having a shape of ellipsoid of rotation and is arranged coaxially with the condenser lens 62 of the soft X-ray microscope. A numerical aperture of the condenser lens 70 is sufficiently larger than that of the objective lens 64, so that zero order light transmitted through the specimen 63 is not made incident upon the objective lens 64. Further, in the illuminating optical system of the visually observing optical system contains the ring slit 68, the visually observing optical system of the present embodiment is of the dark field microscope.

Visible light rays scattered or diffracted by the specimen 63 are focused by the objective lens 64 onto the detector 66. It should be noted that when the specimen 63 is observed under the visible light, the soft X-ray filter 66 is removed from the optical path. As stated above, the detector 66 has a sensitivity for the visible light and converts the optical image of the specimen 63 into an electric signal. The signal produced by the detector 66 is supplied to a signal processing circuit 71 to derive an image signal and the thus produced image signal is supplied to a monitor 72 to display the visible image of the specimen. By monitoring the image of the specimen displayed on the monitor 72, it is possible to perform the alignment of the specimen and focusing adjustment irrespective of the fact that the vacuum chamber is evacuated or not.

Figure 14:
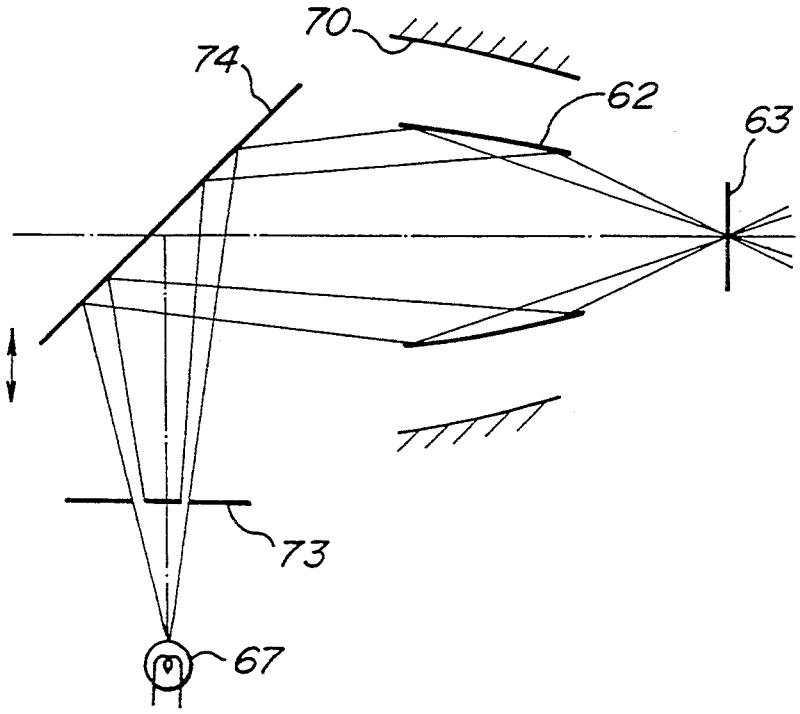
FIG. 14 is a schematic view showing a modification of the fourth embodiment shown in FIG. 14.

FIG. 14 is a schematic view showing a modification of the fourth embodiment shown in FIG. 13. In this modified embodiment, the specimen 63 is observed under the visible light by means of the bright field illumination. To this end, the ring slit 68 in FIG. 13 is exchanged by a ring slit 73 and the mirror with the aperture 69 in FIG. 13 is exchanged by a mirror 74 without an aperture, so that the visible light rays emitted from the visible light source 67 are made incident upon the confessor lens 62 of the soft X-ray microscope.

Figure 15:
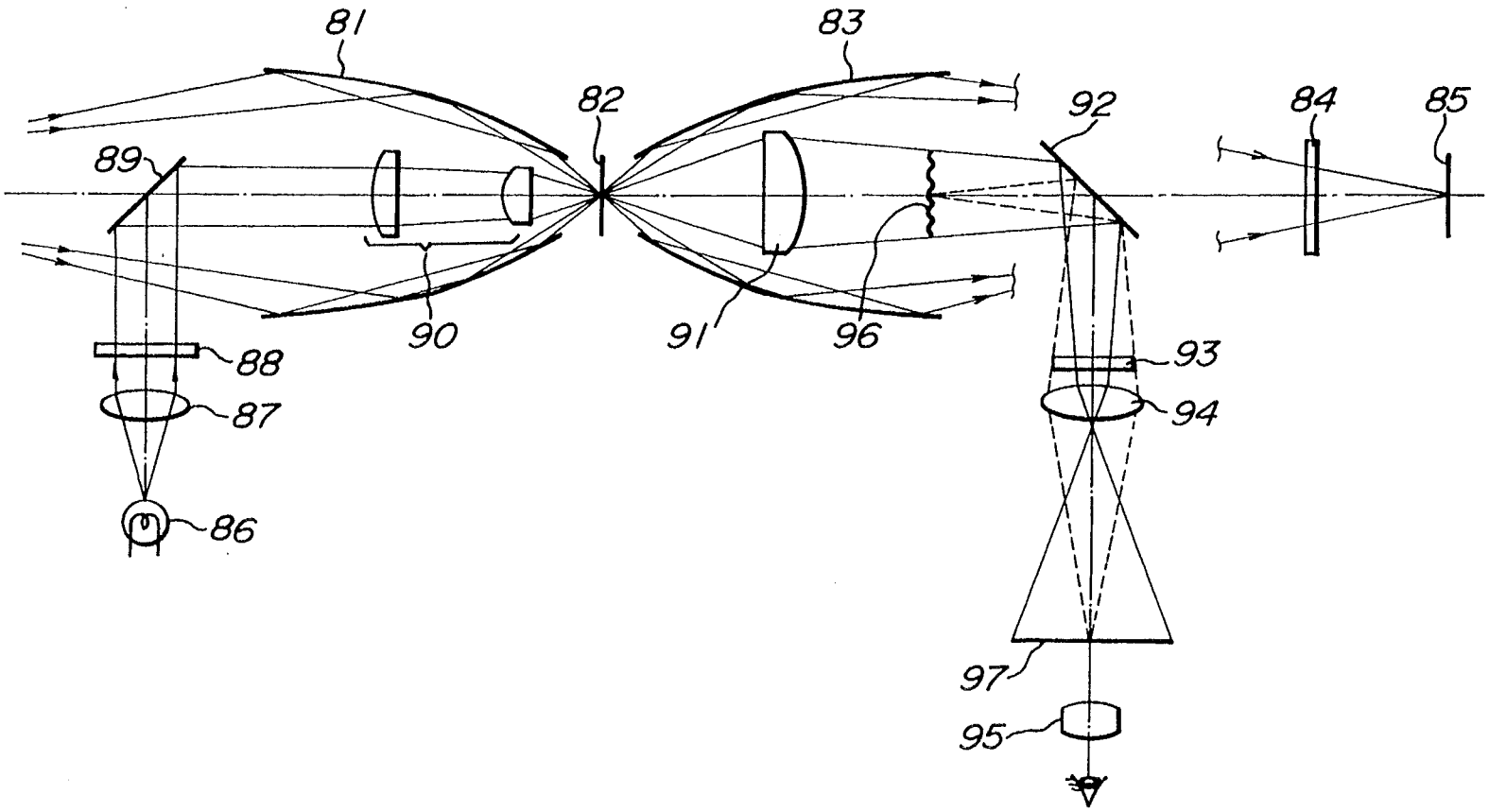
FIG. 15 is a schematic view representing a fifth embodiment of the soft X-ray microscope according to the invention.

FIG. 15 is a schematic view depicting a fifth embodiment of the soft X-ray microscope according to the invention. In the present embodiment, the condenser lens and objective lens of the soft X-ray microscope are formed by the Wolter optical system.

Monochromatic soft X-rays emitted from the SR source and monochromated by the glass hopper type spectrometer not shown are made incident upon a condenser lens 81 formed by the Wolter optical system and are focused thereby onto a specimen 82. Soft X-rays diffracted by the specimen 82 are focused by an objective lens 83 onto a soft X-ray detector 85 via a soft X-ray filter 84. In this manner, the soft X-ray microscope is formed by the Wolter optical systems which are arranged within a vacuum chamber not shown in order to avoid the absorption of the soft X-rays by the air.

In the present embodiment, the visually observing optical system is constructed as the polarizing microscope. The visually observing optical system comprises an illumination system including visible light source 86, collimator lens 87, polarizer 88, mirror 89 and condenser lens 90, and an imaging system including objective lens 91, mirror 92, analyzer 93, Bertrand's lens 94, and eyepiece 95. Visible light emitted by the visible light source 86 is made incident upon the mirror 89 via the collimator lens 87 and polarizer 88 and is reflected thereby along the substantially same optical path along which the soft X-rays are made incident upon the condenser lens 81 of the soft X-ray microscope. The visible light reflected by the mirror 89 is then made incident upon the condenser lens 90. The mirror 89 and condenser lens 90 are arranged on the optical path between the soft X-ray source not shown and the condenser lens 81, so that a size of the mirror 89 and condenser lens 90 has to be sufficiently small such that the soft X-rays are not cut off or shielded by the mirror and condenser lens. In this manner, the specimen 82 is irradiated with the linearly polarized light. If the specimen 82 has an optical anisotropy, the incident linearly polarized light is divided into ordinary light and extraordinary light which are then made incident upon the objective lens 91. The objective lens 91 forms an interference image 96 at its rear focal point, and an image of this interference image is formed by the Bertrand's lens 94 on an image plane 97. This image is viewed by means of the eyepiece 95. In this manner, the anisotropy of the specimen 82 can be visually seen with contrast.

Also in the present embodiment, it is possible to obtain the various advantages which are obtained in the previous embodiments. The visually observing optical system of the present embodiment constitutes the polarizing microscope usually called the conoscope which is generally used for measuring a direction of a crystal axis and measuring the axial property. According to the invention, the polarizing microscope may be constructed as the orthoscope type polarizing microscope using a lower magnitude objective lens instead of the Bertrand's lens.

Figure 16:
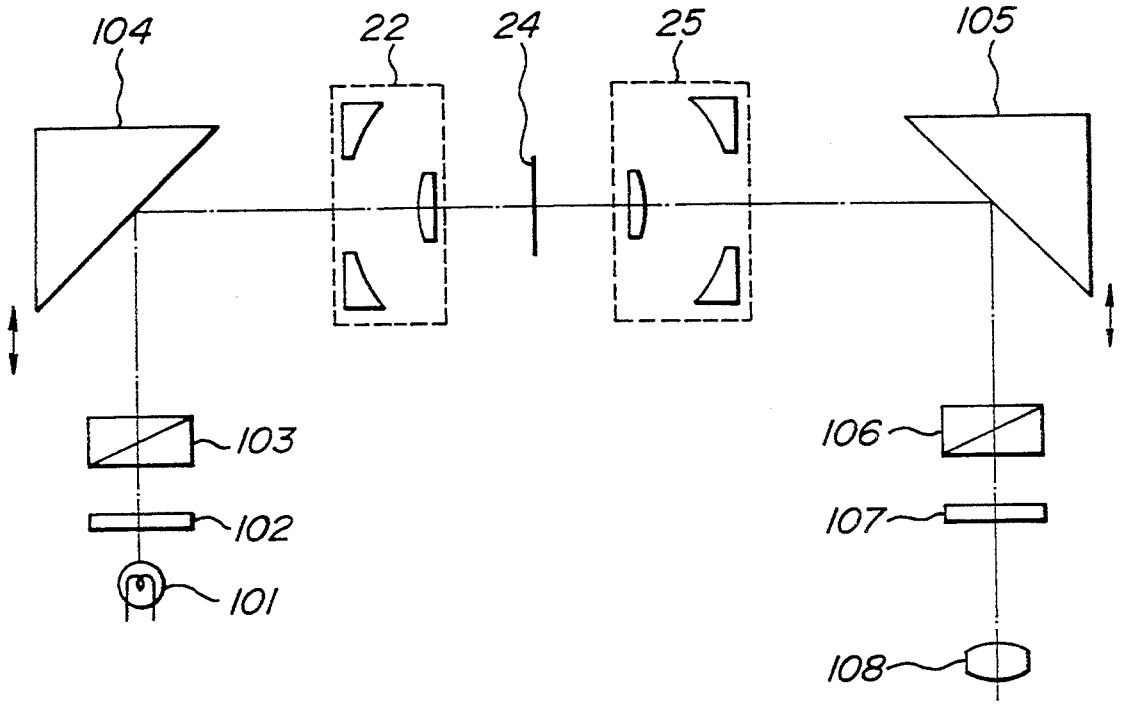
FIG. 16 is a schematic view showing a sixth embodiment of the soft X-ray microscope according to the invention.

FIG. 16 is a schematic view showing a sixth embodiment of the soft X-ray microscope according to the invention. The soft X-ray microscope of the present embodiment is formed in the same manner as the first embodiment shown in FIG. 2. That is to say, the soft X-rays emitted by the soft X-ray source not shown are focused by a condenser lens 22 formed by the Schwaltzschild optical system onto a specimen 24. The soft X-rays emanating from the specimen 24 is then focused by an objective lens 25 also formed by the Schwaltzschild optical system onto a soft X-ray detector not shown via a soft X-ray filter not shown.

In the present embodiment, the visually observing optical system is formed as the differential interference microscope. That is to say, a visible light beam emitted by a visible light source 101 is converted into linearly polarized light beam by a polarizer 102 and then is made incident upon a Wallanstone prism 103. Then, the linearly polarized light beam is divided into two light beams whose vibrating directions are orthogonal to each other. These light beams are parallel with each other and a distance or shear between the light beams is smaller than a resolution of the objective lens 25 for the visible light. Then, these light beams are made incident upon a first prism 104 arranged in the same optical path as that of the soft X-ray microscope and is reflected thereby toward the condenser lens 22 along the optical path along which the soft X-rays are made incident upon the condenser lens 22. The visible light beams are focused onto the specimen 24. The visible light beams emanating from the specimen 24 are focused by means of the objective lens 25 and are made incident upon a second Wallanstone prism 106 via second prism 105 arranged on the optical path of the soft X-ray microscope. Then, the two light beams are converted into a single visible light beam by means of the objective lens 25 and Wallanstone prism 106, and thus obtained visible light beam is made incident upon an analyzer 107. Due to the interference in the analyzer 107, there is formed an visible image having a contrast in brightness or color. This image is seen by means of an eyepiece 108.

In the manner explained above, in the present embodiment, the visually observing optical system is constructed as the differential interference microscope, so that when the specimen 24 has an inclination or a differential coefficient in phase, the contrast image of the specimen can be visually observed.

Figure 17:
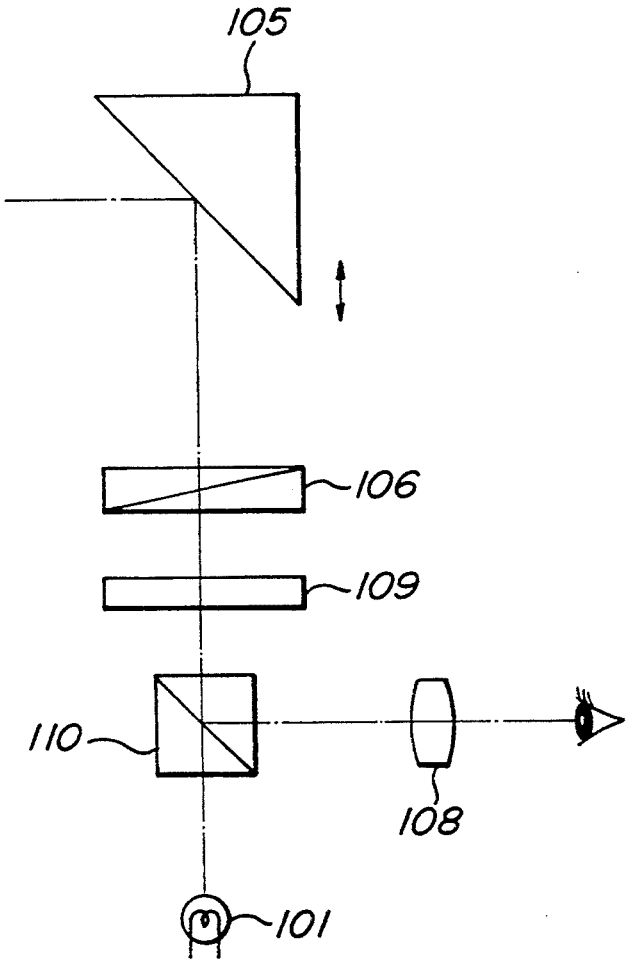
FIG. 17 is a schematic view depicting a modification of the embodiment shown in FIG. 17.

FIG. 17 is a schematic view showing a modification of the sixth embodiment illustrated in FIG. 16. In the embodiment shown in FIG. 16, the differential interference microscope is formed as the transmission type, but in the present modified embodiment, the differential interference microscope is constructed as the reflection type. To this end, the visible light emitted by the visible light source 101 is made incident upon a polarizing element 109 via a beam splitter 110 and the linearly polarized light is made incident upon the prism 105 by means of the Wallanstone prism 107. The visible light reflected by the specimen is made incident upon the polarizing element 109 via the prism 105 and Wallanstone prism 106 to form the visible image of the specimen due to the differential interference. Then, the visible image of the specimen is observed by means of the beam splitter 110 and eyepiece 108.

Figure 18:
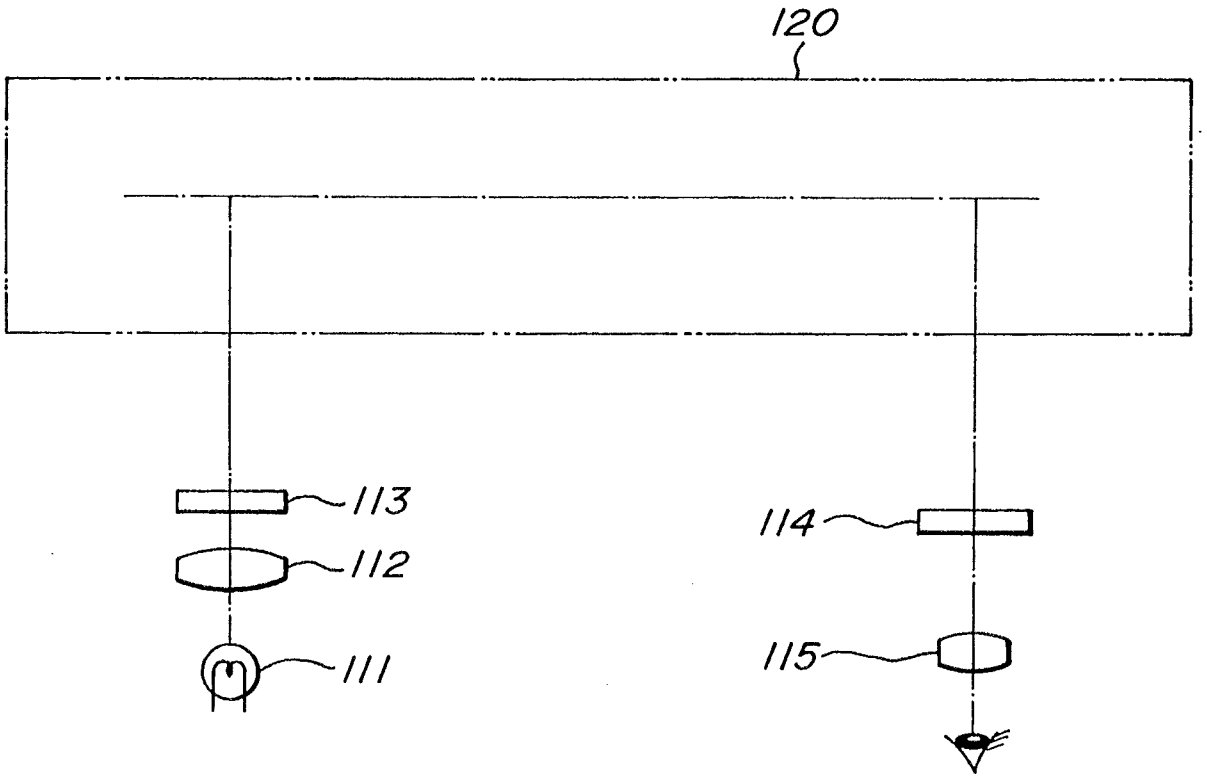
FIG. 18 is a schematic view illustrating a seventh embodiment of the soft X-ray microscope according to the invention.

FIG. 18 is a schematic view illustrating a seventh embodiment of the soft X-ray microscope according to the invention. In the present embodiment, a portion 120 of the microscope is formed like as the second or fourth embodiment in which the microscope is formed as the dark field microscope of transmission type. In the present embodiment, the visually observing optical system is formed as the fluorescent microscope. To this end, there are arranged exciting light source 111 such as a very high pressure mercury discharge lamp, collimator lens 112, exciting filter 113 for selecting only exciting light waving a given wavelength, barrier filter 114 for cutting off the exciting light and eyepiece 115. In the present embodiment, when the exciting light source 111 is energized, the exciting light having the given wavelength is made incident upon the specimen by means of the condenser lens of the soft X-ray microscope. Then, the specimen emits fluorescent light, and this fluorescent light and exciting light are focused by the objective lens of the soft X-ray microscope. However, the exciting light is cut off by means of the barrier filter 114, and therefore only the fluorescent image of the specimen can be observed by means of the eyepiece 115.

Figure 19:
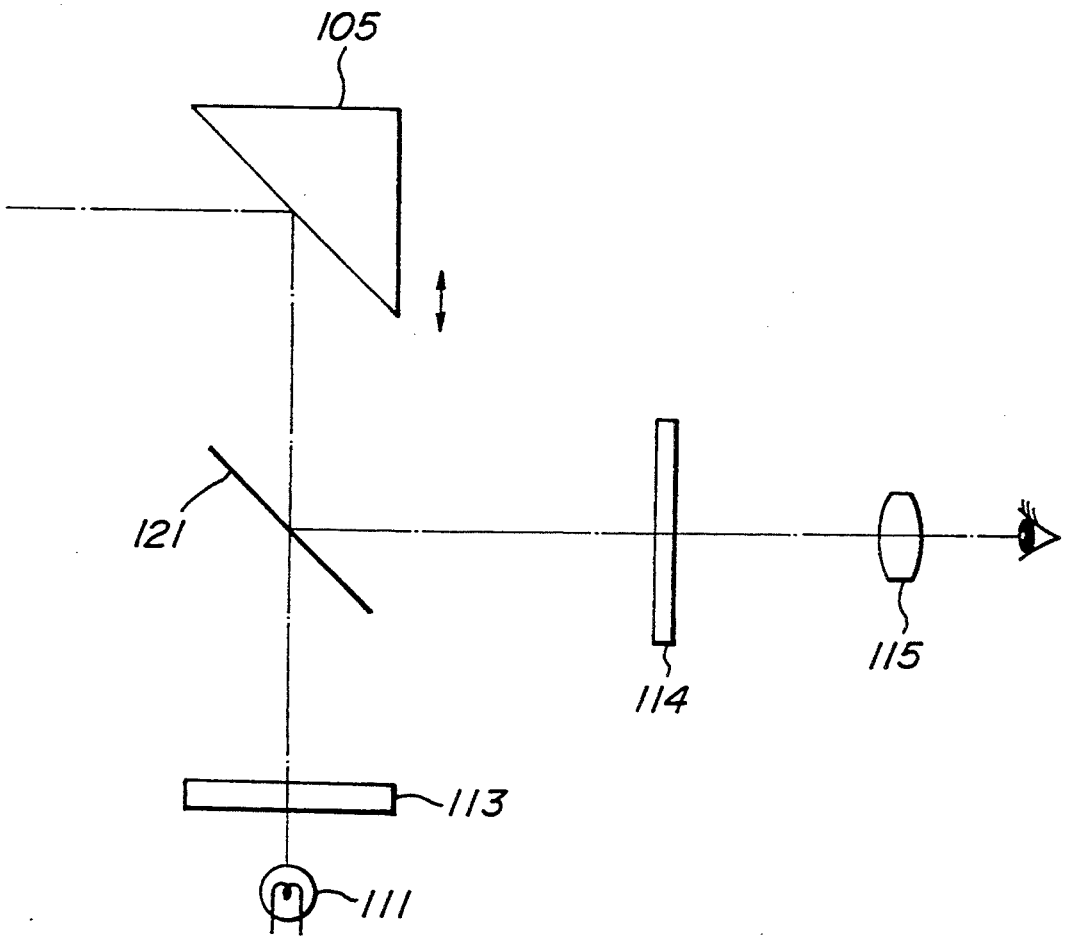
FIG. 19 is a schematic view showing an eighth embodiment of the soft X-ray microscope according to the invention.

FIG. 19 is a schematic view showing an eighth embodiment of the soft X-ray microscope according to the invention. In the present embodiment, the basic construction is similar to that of the modified embodiment illustrated in FIG. 17. In the present embodiment, the visually observing optical system is constructed as the fluorescent microscope of reflection type. That is to say, the light emitted by the exciting light source 111 is passed through the exciting filter 113 to produce the exciting light having a given wavelength which is longer than the vacuum ultraviolet. The thus generated exciting light is made incident upon the prism 105 via a dichroic mirror 121. The exciting light reflected by the specimen is cut off by means of the dichroic mirror 121 and barrier filter 114 and the fluorescent light image of the specimen can be observed by means of the eyepiece 115.

As explained above in detail, in the soft X-ray microscope according to the invention, even if a specimen has a too low contrast to be visually observed by means of the usual bright field microscope, the image of the specimen can be observed under the visible light as long as the specimen reveals a phase difference for the transmitted light, a large scattering or diffraction, has a large optical anisotropy, produces the inclination or differential coefficient in phase, and generates fluorescent light under excitation with the exciting light having a wavelength longer than that of the vacuum ultraviolets. Further, even if a specimen is smaller than a resolution of the bright field visually observing microscope, the image of the specimen can be observed under the visible light as long as the specimen reveals a large scattering or diffraction or generates the fluorescent light under excitation with the exciting light having a wavelength longer than that of the vacuum ultraviolet. Therefore, the alignment of the specimen with respect to the optical axis of the soft X-ray microscope and the focus adjustment of the specimen with respect to the focal point of the objective lens can be performed easily and positively by observing the image of the specimen under the visible light. According to the invention, it is no more necessary to perform the alignment and focus adjustment by irradiating the specimen with the soft X-rays, so that the alignment and focus adjustment can be carried out irrespective of the fact that the vacuum chamber in which the various elements of the soft X-ray microscope are installed is evacuated or not. Therefore, the specimen can be effectively prevented from being subjected to the excessive exposure with the soft X-rays, and further the preparatory operation such as dyeing for the specimen can be dispensed with. This is particularly advantageous for inspecting biological specimens under the natural condition. Moreover, according to the invention, the alignment and focus adjustment can be performed by means of the visually observing optical system, so that these operations can be easily and efficiently effected. Contrary to this, if the alignment and focusing are carried out by inspecting the specimen under the soft X-rays emitted from the SR source, the expensive SR source has to be utilized or if the inspection is performed by means of the laser plasma soft X-ray source, the stroboscopic inspection might affect the above alignment and adjustment.

What is claimed is:

1. A soft X-ray microscope comprising:

a soft X-ray source for generating soft X-rays;

a condenser lens for projecting said soft X-rays emitted from said soft X-ray source onto a specimen;

an objective lens for focusing soft X-rays emanating from the specimen onto a given position; and a soft X-ray detector provided at said given position for detecting the soft X-rays focused by said objective lens; and a visually observing optical system including a visually observing radiation source for emitting visually observing radiation, and an converting means for projecting the visually observing radiation emitted by said visually observing radiation source onto the specimen substantially along an optical path along which said soft X-rays are projected onto the specimen, and for converting an optical property of the specimen other than contrast or color of the specimen into a visible image.

2. A soft X-ray microscope according to claim 1, wherein said visually observing optical system is formed as a phase contrast microscope, said visually observing radiation source is formed by a visible light source for emitting visible light, and said converting means comprises a means for converting a phase difference which is introduced in the visible light transmitted through the specimen into the visible image.

3. A soft X-ray microscope according to claim 1, wherein said visually observing optical system is formed as a dark field microscope, said visually observing radiation source is formed by a visible light source for emitting visible light, and said converting means comprises a means for projecting the visible light onto the specimen, an objective lens for focusing visible light scattered or diffracted by the specimen, and a means for preventing visible light rays which are directly transmitted through and/or reflected by the specimen from being used for forming the image of specimen.

4. A soft X-ray microscope according to claim 1, wherein said visually observing optical system is formed as a polarizing microscope, said visually observing radiation source is formed by a visible light source for emitting visible light, and said converting means comprises a polarizer arranged in an incident visible light and an analyzer arranged in an exit visible light.

5. A soft X-ray microscope according to claim 1, wherein said visually observing optical system is formed as a differential interference microscope, said visually observing radiation source is formed by a visible light source for emitting visible light, and said converting means converts an inclination in phase of the specimen into a contrast in brightness or color.

6. A soft X-ray microscope according to claim 1, wherein said visually observing optical system is formed as a fluorescent microscope and said visually observing radiation source is formed by an exciting light source for emitting exciting light, and said converting means comprises an illuminating means for projecting the exciting light onto the specimen to produce fluorescent light and an imaging optical system for focusing said fluorescent light emanating from the specimen to produce the visible image.

* * * * *